US005636416A

United States Patent [19]

Anderson

[11] Patent Number: 5,636,416

[45] Date of Patent: Jun. 10, 1997

[54] GARBAGE BAG MAINTENANCE SYSTEM AND METHOD

[76] Inventor: Michael J. Anderson, 117 S. 1250 East, Logan, Utah 84321

[21] Appl. No.: 499,858

[22] Filed: Jul. 10, 1995

[51] Int. Cl.[6] ..... A44B 21/00

[52] U.S. Cl. ..... 24/510; 24/30.5 R; 24/505; 24/507

[58] Field of Search ..... 24/30.5 P, 30.5 R, 24/505, 507, 510

[56] References Cited

U.S. PATENT DOCUMENTS

| | | | |
|---|---|---|---|
| 2,531,003 | 11/1950 | Slaker | 24/510 |
| 2,979,060 | 4/1961 | Reiner | 24/507 X |
| 4,394,791 | 7/1983 | Groth | 24/30.5 R |
| 4,835,820 | 6/1989 | Robbins, III | 24/30.5 R |
| 4,932,955 | 6/1990 | Merz et al. | 24/510 X |
| 5,267,374 | 12/1993 | Drake | 24/30.5 R |
| 5,305,500 | 4/1994 | Tucker | 24/30.5 R |
| 5,473,796 | 12/1995 | Fusillo | 24/30.5 R |
| 5,481,784 | 1/1996 | Sinaiko | 24/67.9 |

*Primary Examiner*—Peter M. Cuomo
*Assistant Examiner*—Stephen Vu
*Attorney, Agent, or Firm*—Thorpe, North & Western

[57] ABSTRACT

A device and method for securing a plastic bag within a trash receptacle or other receptacle are provided. The garbage bag maintenance system device employing a front and rear plate in springing engagement with one another, the front plate employing an opening through which a portion of a trash container liner is threaded, when the desired amount of the trash container liner is threaded through the opening, the front and back plate are released causing them to shut over a portion of the trash container liner thereby creating a snug engagement between the trash container liner and the top rim of a trash container. This engagement of the trash container liner with the front and back plate of the device holds the trash container liner in place so that it remains substantially in the position it is adjusted to and resists being pushed down into the trash container.

12 Claims, 3 Drawing Sheets

GARBAGE BAG MAINTENANCE SYSTEM AND METHOD

BACKGROUND

1. The Field of the Invention

This invention relates generally to the retention of plastic or other liners in the interior of receptacles and more specifically to the securing of a trash bag in a trash container so that as to protect the container and enhance the effectiveness of the trash bag in containing the trash placed therein.

2. The Background Art

A variety of devices for securing plastic liners in trash containers have developed. With the advent of plastic grocery bags, many of these devices have been directed to utilizing plastic grocery bags as trash container liners. Thus, a large number of devices aimed at securing grocery bags inside trash containers by the handles of the grocery bags exist.

Unfortunately, grocery bags or other plastic liners with handles are not always available. Devices aimed at holding bags with handles inside trash containers rarely, if ever, function adequately to hold liners which have no handles.

Trash containers have also been modified such that they are capable of securing a plastic liner securely in and around the container. This is most often accomplished by incorporating some sort of protrusion, having a securing element for securing the trash container liner, into the design of the trash container.

Utilization of this type of device is, however, necessarily limited to those trash containers which have been manufactured with such devices incorporated. Those wishing to utilize their existing trash receptacles or trash receptacles of another style are unable to take advantage of the benefits of this type of system for securing a trash container liner.

Another type of securing mechanism for securing trash container liners in place involves the use of a number of clips. The trash container liner is positioned as desired over the lip of the trash container. The clips are then secured to the lip of the trash container thus capturing the trash container liner between the clip and the lip of the trash container.

This type of system also has drawbacks, specifically, it can be rather cumbersome to utilize. The user must somehow hold the entire circumference of the trash container liner in position while installing the clips or must take time between installation of each clip to position the next section of the trash can liner. As will be appreciated, this can be time consuming. Additionally, such clips tend to become soiled as they are in the direct path of refuse being disposed of in the trash container.

It would therefore be an advantage in the art to provide a system for adjusting and maintaining a trash container liner in a desired position which allowed for easy adjustment of the trash container liner to a desired position, typically in snug engagement with the top circumference of the receptacle, which could be easily engaged to retain the trash container liner in the desired position, and which could be used in conjunction with a variety of receptacles.

BRIEF SUMMARY AND OBJECTS OF THE INVENTION

A device and method for securing a trash bag in a trash container so that it does not become dislodged or pushed into the trash container is provided by the present invention. As will be appreciated, if a trash bag or liner becomes dislodged or pushed into the trash container it cannot perform the desired functions of containing the trash placed in the trash container and protecting the interior surface of the trash container.

The present invention employs a springingly engaged front and back plate. An opening in the front plate allows for adjustment of the trash container liner to the trash container. Also incorporated in the front and back plate are finger grips which allow a user to force front and back plate apart so that a trash liner may be threaded through the device.

In use, the front and back plates are separated by applying force to finger grips. The trash container liner is then threaded through the opening in the front plate. The trash container liner is then adjusted to the desired position and tension around the circumference of the trash container by pulling a sufficient portion through the opening in the front plate. When the trash container liner is positioned as desired, generally snug against the entire circumference of the trash container, the user releases the finger grips and allows the front plate to spring closed against the back plate thus firmly capturing the trash container liner.

Accordingly, it is a primary object of the present invention to provide a device for securing a trash container liner in a desired position with respect to a trash container.

It is a further object of the present invention to provide a device for securing a trash container liner in a desired position with respect to a trash container that can be utilized with a large variety of trash containers.

It is a still further object of the present invention to provide a device for securing a trash container liner in a desired position with respect to a trash container which can be used with various types of trash container liners including both those with handles and those without.

It is an additional object of the present invention to provide a device for securing a trash container liner in a desired position with respect to a trash container that is easily installed and operated.

It is another object of the present invention to provide a device for securing a trash container liner in a desired position with respect to a trash container that remains clear of the refuse deposited therein.

It is yet another object of the present invention to provide a device for securing a trash container liner in a desired position with respect to a trash container that is economical.

These and other objects of the present invention will become more fully apparent from the following description and appended claims or may be learned by the practice of the invention as set forth herein.

BRIEF DESCRIPTION OF THE DRAWINGS

In order to more fully understand the manner in which the above-recited and other advantages and objects of the present invention are obtained, a more particular description of the invention briefly described above will be rendered by reference to the presently understood best mode for making and using the same, as illustrated in the appended drawings. Understanding that these drawings depict only typical embodiments of the invention and are, therefore, not to be considered as limiting of its scope, the invention will be described with additional specificity and detail through the use of the accompanying drawings in which.

DETAILED DESCRIPTION OF THE PREFERRED EMBODIMENTS

Reference is now made to the embodiments and methods illustrated in FIGS. 1 through 11 wherein like numerals are used to designate like parts throughout.

Figure 1:
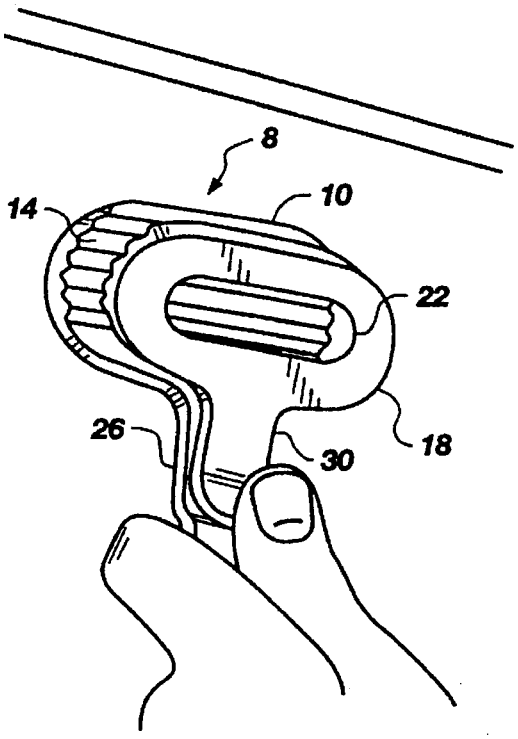
FIG. 1 is a perspective view of the trash container liner maintenance device of the present invention during the first step of use.

Referring to FIGS. 1 through 4 a method of using the inventive device are illustrated. In FIG. 1, the device is shown being grasped by a user in preparation for engaging a liner of a trash container. The device, depicted generally as 8, includes a back plate 10 which incorporates a gripping surface employing ridges 14.

A front plate 18 is in springing engagement with back plate 10 such that front plate 18 and back plate 10 are urged toward each other in the absence of outside forces. As shown, front plate 18 also incorporates an opening 22. In the step of FIG. 1, a user applies force to device 8 by pinching back finger grip 26 and front finger grip 30. This action forces front plate 18 and back plate 10 slightly apart.

Figure 2:
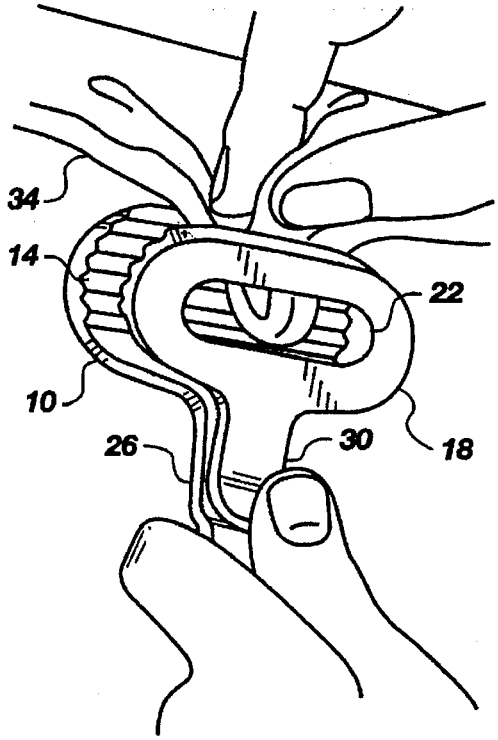
FIG. 2 is a perspective view of the trash container liner maintenance device of the present invention during a subsequent step of use.

Turning to FIG. 2, a portion of the top of edge of a trash bag or trash container liner 34 is being threaded into opening 22 in front plate 18. As illustrated, the trash container liner 34 is placed between front plate 18 and back plate 10 and then out through opening 22. This places trash container liner 34 in position to be gripped by ridges 14 in front plate 18 and back plate 10 when front plate 18 and back plate 10 are released.

Figure 3:
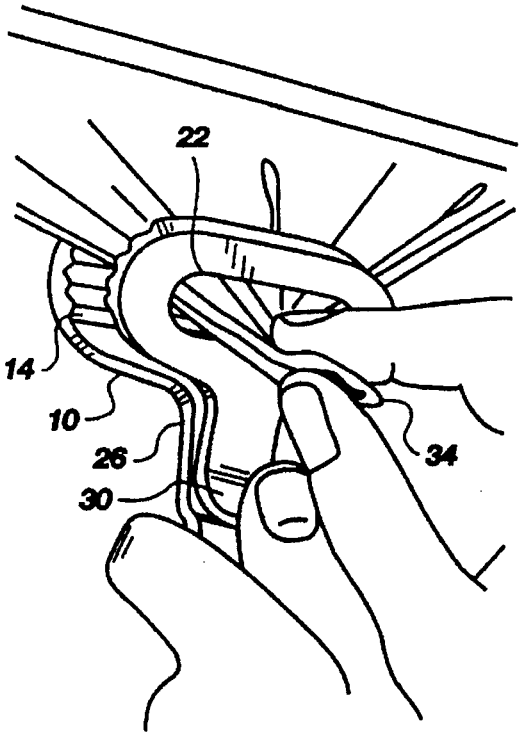
FIG. 3 is a perspective view of the trash container liner maintenance device of the present invention during a subsequent step of use.

FIG. 3 depicts trash container liner 34 being pulled through opening 22 in front plate 18. Trash container liner 34 is pulled through opening 22 in front plate 18 preferably until the top edge of trash container liner 34 is pulled tightly around the circumference of the trash container. When trash container liner 34 is held in snug engagement with the top circumference of a trash container or other receptacle, trash container liner 34 is substantially resistant to being dislodged or pushed into the receptacle. As will be appreciated, trash container liner 34 can better serve the purpose of containing the refuse placed therein and protecting the interior surface of the trash container or other receptacle if trash container liner 34 is securely positioned in relation to the trash container or other receptacle.

Figure 4:
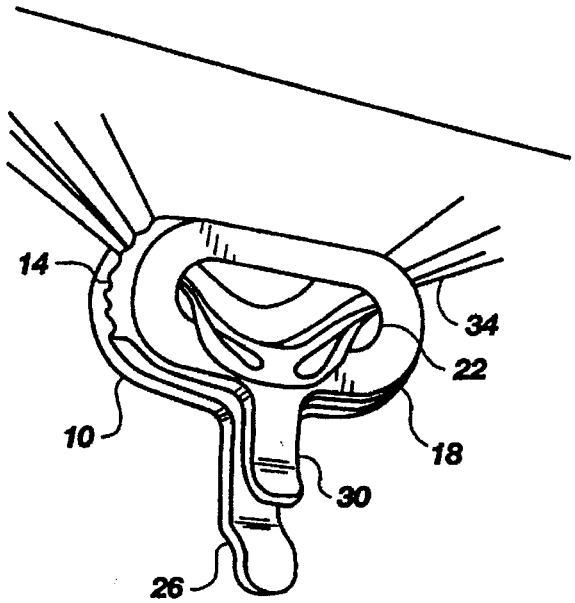
FIG. 4 is a perspective view of the trash container liner maintenance device of the present invention as engaged by the prior steps of use.

In FIG. 4, the inventive device as it appears once properly positioned with a sufficient portion of trash container liner 34 being pulled through opening 22 is illustrated. As shown, this effects a snug engagement of the trash container liner with the top circumference of the opening of a trash container.

Figure 5:
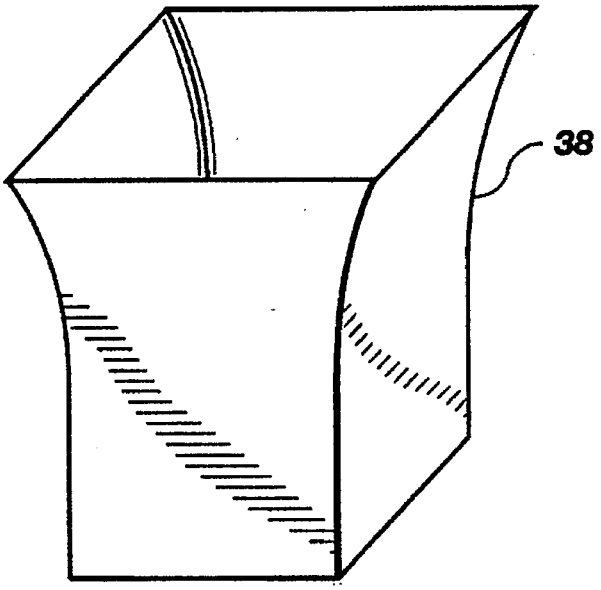
FIG. 5 is a perspective view of a typical trash container with which the device of the present invention might be employed.
Figure 6:
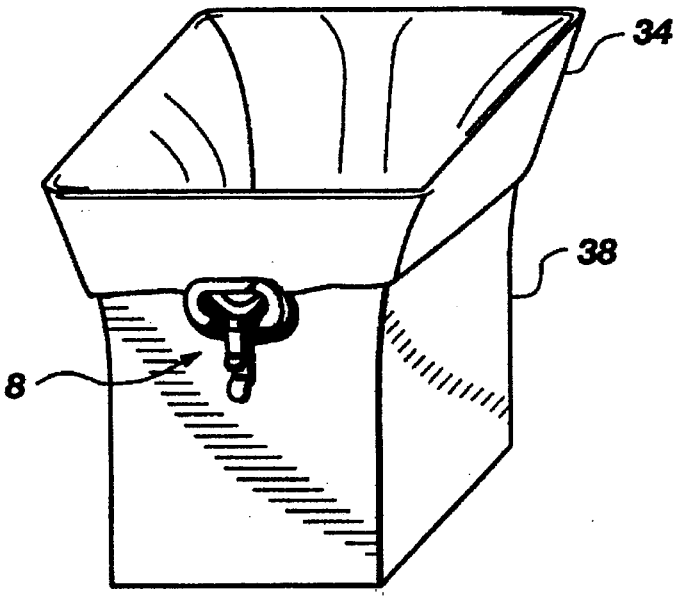
FIG. 6 is a view of the device as it might appear in use with the trash container of FIG. 5 following the steps illustrated in FIGS. 1 through 4.

This effect is best shown in relation to FIG. 5 and 6 which better illustrate the use of the inventive device with a typical trash container. FIG. 5 depicts a typical trash container 38. FIG. 6 illustrates device 8 in place with a trash container liner 34 installed. As shown, trash container liner 34 is held in snug engagement with the top circumference of trash container 38. This snug engagement eliminates or substantially reduces the tendency for trash container liner 34 to be pushed into trash container 38. This allows trash container liner 34 to better contain refuse placed therein and to better protect the interior surface of trash container 38.

Also best seen in FIG. 6 is the relation of the inventive device 8 to the top of trash container 38. As depicted, device 8 resides in the area of the top circumference of trash container 38 but somewhat below the plane defined by the top circumference of trash container 38. This positioning allows device 8 to remain substantially out of the path of refuse being deposited into trash container 38. By being located substantially out of the path of refuse being deposited, device 8 is less likely to become soiled by such refuse. Thus, this positioning reduces the effort needed to maintain the device by reducing or eliminating the need for cleaning the device.

Figure 7:
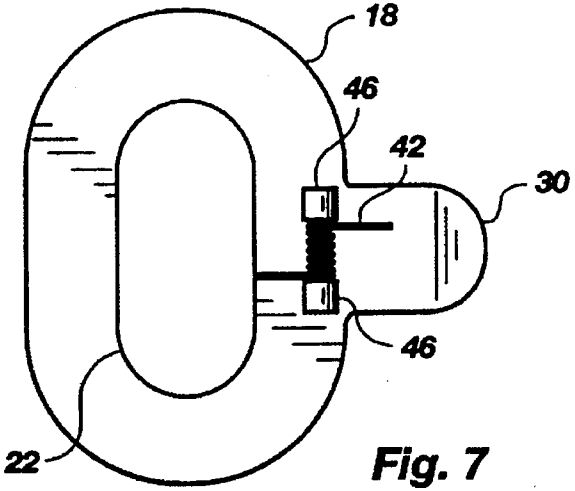
FIG. 7 is a top view of the front plate of a presently preferred embodiment of the trash container liner maintenance device of the present invention.

Turning to FIG. 7, further detail of front plate 18 of a presently preferred embodiment of the inventive device is shown wherein the front plate 18 forms an annulus or ring. As depicted, opening 22 within the ring is preferably large enough to allow for ease of feeding of a portion of a trash container liner. In this embodiment, opening 22 has greater length than height and is rounded on each end to approximately imitate the exterior shape of front plate 18. It will be appreciated, however, that opening 22 could assume a variety of shapes and sizes without effecting the operation of the device.

For example, opening 22 could be rectangular, triangular, or polygonal among others. In addition, opening 22 could be substantially smaller or larger. Opening 22 may be adjusted in size for specific applications and to accommodate thicker or thinner liners. As will be appreciated, a larger opening may be desirable in applications where particularly thick liners will be employed. Similarly, a smaller opening may be desirable if a thinner liner is to be utilized. In most cases, it will be preferable, however, to insure that opening 22 is of adequate size to allow for threading of a portion of the liner through opening 22 by hand without the need for additional tools.

Front plate 18 is typically constructed of high impact plastic, although a variety of other materials could be employed. Front plate 18 is preferable manufactured using injection molding techniques, although other plastic forming manufacturing methods may be employed. In addition, other plastics, metals, wood, graphite, and other mediums are all suited to implementation of the device of the present invention. Manufacturing methods suitable to the material of choice would then be employed.

Steel spring 42 which serves to springingly engage front plate 18 to the back plate (not shown in this figure) is also illustrated. As depicted, steel spring 42 works in conjunction with a hinge, the front portions 46 of which are shown in this view.

Figure 8:
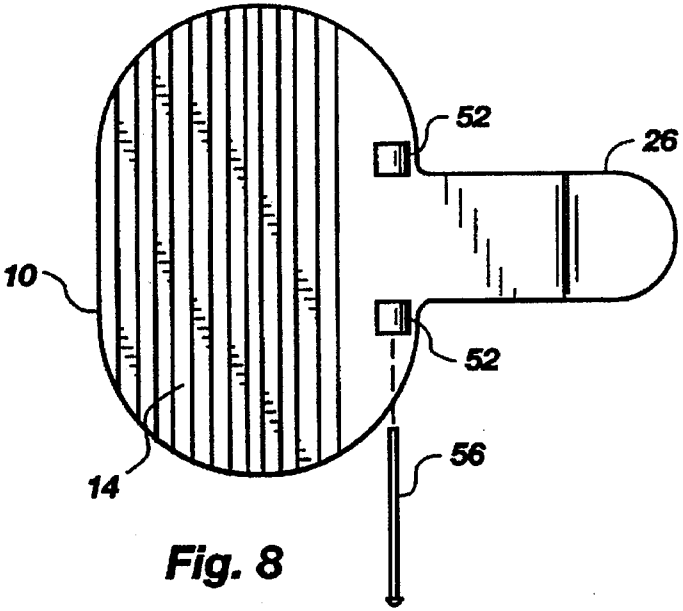
FIG. 8 is a is a side view of the front plate of a presently preferred embodiment of the trash container liner maintenance device of the present invention.

FIG. 8 illustrates back plate 10. In this view, rear portions 52 of the hinge are shown as is steel pin 56 which serves to hold the front portion of the hinge (as shown in FIG. 7) in engagement with rear portions 52 and also with the spring (also shown in FIG. 7).

Back plate 10 is typically constructed of high impact plastic, although a variety of other materials could be employed. As will be appreciated, other plastics, metals, wood, graphite, and other mediums are all suited to implementation of the device of the present invention.

Figure 9:
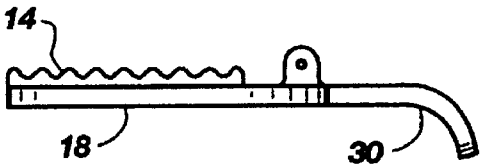
FIG. 9 is a top view of the back plate of a presently preferred embodiment of the trash container liner maintenance device of the present invention.

In FIG. 9, a side view of front plate 18 is depicted. In this view ridges 14 are visible. In a preferred embodiment, ridges 14 would cover the substantially the entire surface surrounding the opening. It will be appreciated, however, that only a portion of the surface need contain ridges 14 for adequate gripping to be achieved. In addition, other gripping surfaces could be employed to achieve the same effect.

Also illustrated in this view is front finger grip 30. As shown, in a preferred embodiment front finger grip 30 deflects approximately ⅜ of an inch from the plane of front plate 18. Front finger grip 30 in conjunction with back finger grip 26 allow a user to apply the force necessary to the device to urge front plate 18 away from back plate 10.

Figure 10:
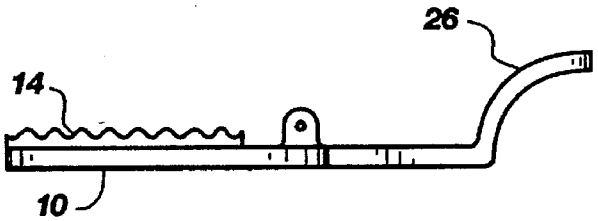
FIG. 10 is a side view of a presently preferred embodiment of the back plate of the trash container liner maintenance device of the present invention.

FIG. 10 illustrates further details of back plate 10. As shown, in this embodiment ridges 14 cover approximately the top inch and three quarters of back plate 10. It will be appreciated, however, that a smaller gripping surface could be employed to achieve similar results providing an adequate amount of the gripping surface of back plate 10 is positioned so as to interact with front plate 18.

Although the preferred embodiment illustrated in FIGS. 1 through 11 employs a squared off oval shape, nearly any other shape could be employed. For example, the device could be manufactured to be rectangular, triangular, circular, and polygonal among others. In addition, the front plate and the back plate may be of different shapes providing an adequate interaction between the surface of the front plate and the surface of the back plate is maintained.

As shown, in a preferred embodiment back finger grip 26 would extend approximately ⅝ of an inch from the plane of back plate 10. The arc of back finger grip is designed to give the user purchase to apply the force necessary to urge front plate 18 and back plate 10 away from each other so that a trash container liner can be threaded between front plate 18 and back plate 10 and through the opening in front plate 18.

Figure 11:
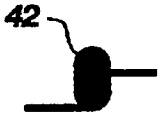
FIG. 11 is a side view of the spring used to hold the front plate and the back plate of the present invention in springing engagement with one and other.

Turning to FIG. 11 a presently preferred embodiment of the spring 42 employed to hold the front plate and the back plate in springing engagement is illustrated. Spring 42 is preferably fashioned of steel, although high strength plastic or other materials could be employed.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A container with a removable plastic Liner and an attachment clip for holding the liner in place, comprising:

a support container having an upper rim;

a plastic liner inserted within the support container and having an upper edge wrapped over the upper rim and around the support container;

at least one attachment clip coupled to the upper edge of the liner which extends around the receptacle, said attachment clip comprising opposing first and second plates coupled together at one side, said second plate being configured as an annulus surrounding an annular opening within the second plate, said attachment clip including:

a gripping means applied to the first and second plates and having the liner captured in a desired position between the first and second plates and in relation to the receptacle; and an adjustment means formed by the attachment means and gripping means, in combination with the annular opening of the second plate, and having a section of the liner extending through the second plate and retained within the gripping means, for adjusting said liner to said desired position.

2. A container with a removable plastic liner and an attachment clip for holding the liner in place as defined in claim 1 wherein said attachment means includes an adhesive applied to at least one of the first or second plates.

3. A container with a removable plastic liner and an attachment clip for holding the liner in place as defined in claim 1 wherein said gripping means comprises the first plate coupled in springing engagement with the second plate such that, in the absence of outside forces, said first and second plates are urged toward each other.

4. A container with a removable plastic liner and an attachment clip for holding the liner in place as defined in claim 3 further comprising ridge means formed in said first and said second plates for locking said liner in a desired position.

5. A container with a removable plastic liner and an attachment clip for holding the liner in place as defined in claim 3 further comprising ridge means formed in either of the first or second plates.

6. A container with a removable plastic liner and an attachment clip for holding the liner in place as defined in claim 3 wherein said first plate and said second plate are manufactured of high impact plastic.

7. A container with a removable plastic liner and an attachment clip for holding the liner in place as defined in claim 3 wherein at least one of said first and second plates are substantially oval in shape.

8. A container with a removable plastic liner and an attachment clip for holding the liner in place as defined in claim 3 wherein at least one of said first and second plates are substantially rectangular in shape.

9. A container with a removable plastic liner and an attachment clip for holding the liner in place as defined in claim 3 wherein at least one of said first and second plates are substantially triangular in shape.

10. A container with a removable plastic liner and an attachment clip for holding the liner in place as defined in claim 3 wherein at least one of said first and second plates are substantially polygonal in shape.

11. A container with a removable plastic liner and an attachment clip for holding the liner in place as defined in claim 3 wherein at least one of said first and second plates are substantially circular in shape.

12. A container with a removable plastic liner and an attachment clip for holding the liner in place as defined in claim 3 further comprising finger grip means attached at one side of the attachment means for providing access for a user to apply force to said first and second plates to thereby urge the first and second plates apart.

* * * * *